US009770801B2

(12) United States Patent
Lilienberg

(10) Patent No.: US 9,770,801 B2
(45) Date of Patent: Sep. 26, 2017

(54) GRINDING/MILLING MACHINE FOR LEVELLING OF HORIZONTAL SURFACES

(71) Applicant: Per-Erik Lilienberg, Alvesta (SE)

(72) Inventor: Per-Erik Lilienberg, Alvesta (SE)

( * ) Notice: Subject to any disclaimer, the term of this patent is extended or adjusted under 35 U.S.C. 154(b) by 0 days.

(21) Appl. No.: 15/306,636

(22) PCT Filed: Apr. 27, 2015

(86) PCT No.: PCT/SE2015/050472
§ 371 (c)(1),
(2) Date: Oct. 25, 2016

(87) PCT Pub. No.: WO2015/167394
PCT Pub. Date: Nov. 5, 2015

(65) Prior Publication Data

US 2017/0043445 A1 Feb. 16, 2017

(30) Foreign Application Priority Data

Apr. 29, 2014 (SE) ..... 1450510

(51) Int. Cl.
*B24B 7/18* (2006.01)
*B24B 27/00* (2006.01)

(52) U.S. Cl.
CPC ..... *B24B 7/186* (2013.01); *B24B 27/0007* (2013.01)

(58) Field of Classification Search
CPC ... B24B 7/186; B24B 27/0007; B24B 41/047; B24B 55/102; A47L 11/4069; A47L 11/4038
USPC ..... 451/353
See application file for complete search history.

(56) References Cited

U.S. PATENT DOCUMENTS 1,550,102 A * 8/1925 Schlueter ..... B24B 7/18 15/49.1
1,832,267 A * 11/1931 Toffolo ..... B24B 7/186 15/49.1
2,759,305 A * 8/1956 Helbig ..... A47L 11/16 15/49.1
5,070,656 A * 12/1991 Brogden ..... B24B 7/186 15/49.1
9,272,383 B1 * 3/2016 Dickson ..... B24B 23/03
2007/0264917 A1 * 11/2007 Lundberg ..... B24B 7/186 451/353
2009/0019652 A1 1/2009 Goldberg et al.
2010/0197210 A1 8/2010 Goldberg et al.
2013/0084782 A1 * 4/2013 McCutchen ..... B24B 7/186 451/28

FOREIGN PATENT DOCUMENTS

EP 1970160 9/2008

OTHER PUBLICATIONS

International Search Report for PCT/SE2015/050472, Completed by the Swedish Patent Office on Jun. 24, 2015, 5 Pages.

* cited by examiner

*Primary Examiner* — George Nguyen
(74) *Attorney, Agent, or Firm* — Brooks Kushman P.C.

(57) ABSTRACT

A grinding/milling machine for levelling of horizontal surfaces, having a mobile drive unit, including a vertically pivotable boom suspended from the mobile unit, a rigid girder pivotally fastened at the end of the boom and two motorized machining and/or milling machines, each being arranged at a respective opposite end of the rigid girder.

5 Claims, 3 Drawing Sheets

1
2
3
4
5
6
7
8
9
10
11
12
13
14
15
16
17
18
19
20
21
22
23
24
25
26
27
28
29
30
31
32
33
34
35
36
37
38
39
40
41

GRINDING/MILLING MACHINE FOR LEVELLING OF HORIZONTAL SURFACES

CROSS-REFERENCE TO RELATED APPLICATION

This application is the U.S. national phase of PCT Application No. PCT/SE2015/050472 filed on Apr. 27, 2015, which claims priority to SE Patent Application No. 1450510-1 filed on Apr. 29, 2014, the disclosures of which are incorporated in their entirety by reference herein.

The present invention relates to a grinding/milling machine for levelling of horizontal surfaces, in particular for large scale work, e.g. grinding of concrete floors in an industrial building, milling of asphalt paved surfaces, etc.

BACKGROUND

When machining concrete surfaces with tools sitting on a horizontal rotating disc, there are lateral forces, which strongly limit the capacity. In order to remedy this, grinding means have been developed, having oscillating tool holders, and by suitable control any force acting in one particular direction is neutralized.

Prior art grinding/milling means are often complicated and expensive, while at the same time they have a limited working area and accordingly they have to be moved back and forth over the working area many times, with a resulting risk for edges at the interfaces between the machined surface areas.

Accordingly, there is a great need of a machine working on large areas and having a substantial working width, but which still can be controlled very exact and the operation of which easily can be adapted to any obstacles existing on the working surface.

SUMMARY OF THE INVENTION

Accordingly, the object of the invention is to provide a grinding/milling machine which substantially shortens the working time when levelling large horizontal surfaces, such as concrete floors in industrial buildings, asphalt paved surfaces and similar objects.

This is achieved with the present invention with the characterizing features defined in claim 1. Developments and preferred embodiments of the invention are defined in the sub claims.

SHORT DESCRIPTION OF THE DRAWINGS

The invention will now be described more in detail in connection with embodiments of the invention, which are illustrated on the drawings, in which FIG. 1 schematically shows a perspective view of a grinding/milling machine according to one embodiment of the invention with an accompanying mobile drive unit;

DETAILED DESCRIPTION OF THE INVENTION

Figure 1:
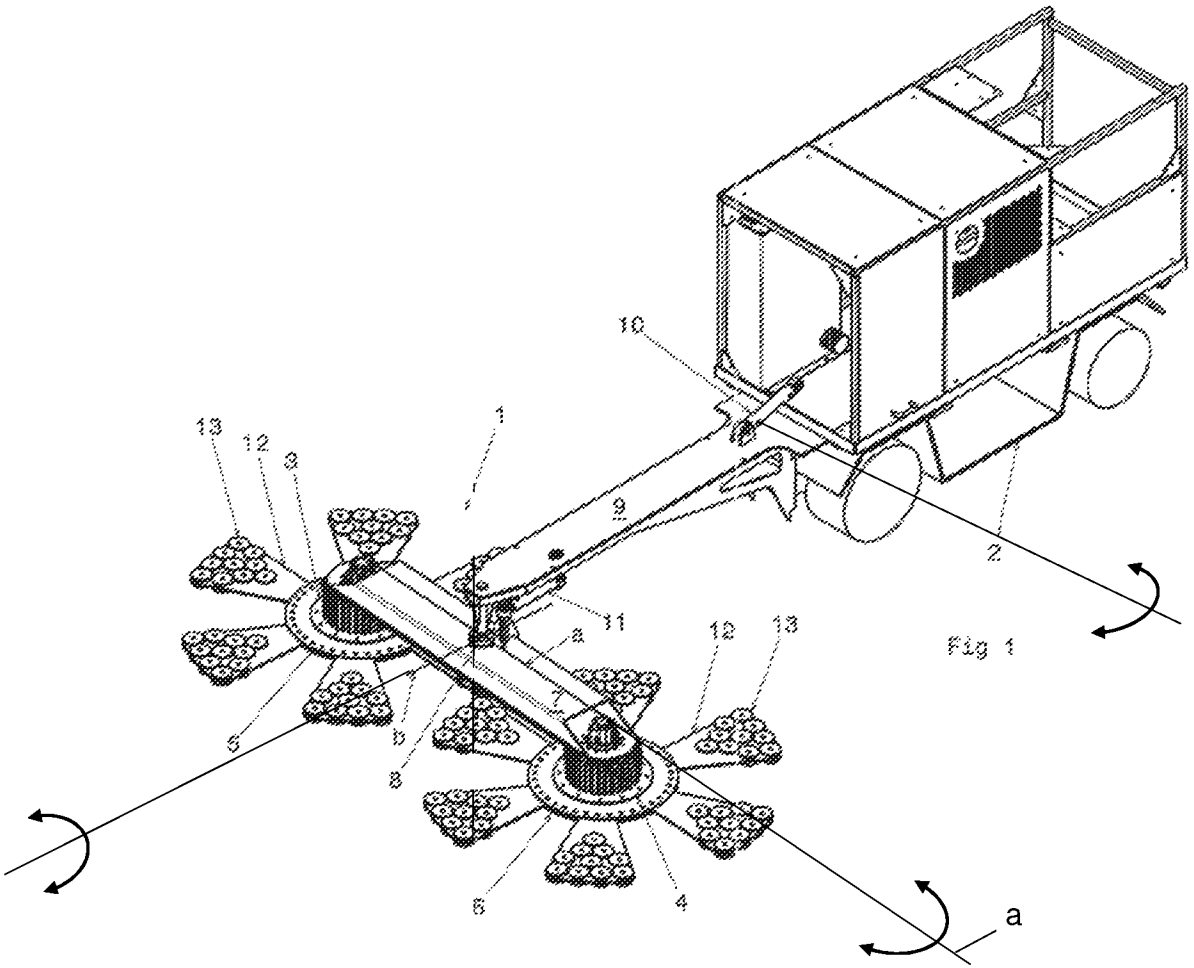

As is shown in the Figures, the grinding/milling machine 1 according to the invention is designed in such a way that it is moved over the surface to be levelled by a mobile drive unit 2, which further comprises equipment necessary for the grinding/milling, such as hydraulic pump, electric generator, computer capacity, sensors, etc.

The machining and/or milling parts of the unit according to the invention are comprised of two motorized 3, 4 discs 5, 6, each being arranged at a respective opposite end of a rigid girder 7.

The rigid girder 7 is arranged in a joint 8 at one end of a boom 9, which in its turn is vertically pivotally hinged in a joint at the mobile drive unit 2. At this joint a hydraulic cylinder 10 is arranged, with which the boom can be lifted and be pressed against the ground, respectively, which will be discussed more in detail below.

At the joint 8 there is also arranged a hydraulic cylinder 11, with which the rigid girder 7 is pivoted in relation to the boom 9 in a horizontal direction. By designing the joint 8 as a ball joint besides the pivotability in the horizontal plane, it is also possible to rotate the rigid girder 7 around a longitudinal axis, designated with "a" in FIG. 1, traversing said joint, and also around a transversal axis, designated with "b" in FIG. 1 and FIG. 2, whereby a varying inclination of the ground automatically can be taken up by the unit according to the invention.

The motors 3, 4 operate the discs 5, 6, so that they rotate in opposite directions in relation to each other, so that lateral forces occurring thereby will even out each other.

According to a preferred embodiment of the invention each disc 5, 6 has fastening means for tool carriers in the form of disc formed elements 12 with a narrower fastening end 12*a* and a wider working end 12*b*. Thereby, each tool carrier 12 are fastened with bolts, having an extension such that nothing protrudes on the underside of the discs. Means 13 are arranged on the tool carriers for fastening machining tools and tools that removes material, respectively.

According to a further development the tool carriers have fastening means on both sides, and can accordingly carry similar or different tools on their respective sides.

The two discs with the tool carriers thereon can either be arranged with an interspace between the scan lines for the outer parts of the tool carriers, or so that the tool carriers on the respective discs overlap each other to a small extent, and so that the discs are fastened in such a way that a tool carrier on one disc ends up in an interspace between two tool carriers on the other disc.

In order to achieve a simpler and thereby also more economic construction and also a higher safety it is preferred to arrange the discs so that a certain distance exists during the rotation. By tilting the rigid girder 7 in relation to the boom 9 the machined and milled surfaces, respectively, can be made to lie adjacent to each other or to overlap each other.

Figure 2:
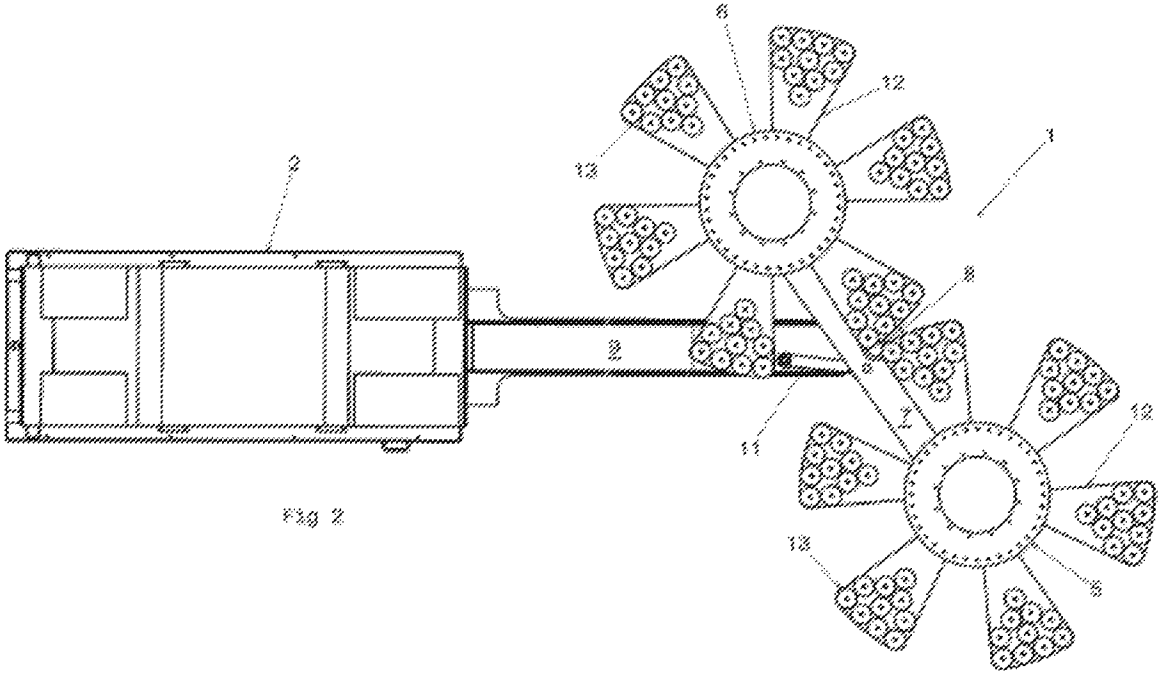
FIG. 2 shows a view from underneath of the unit shown in FIG. 1.
Figure 3:
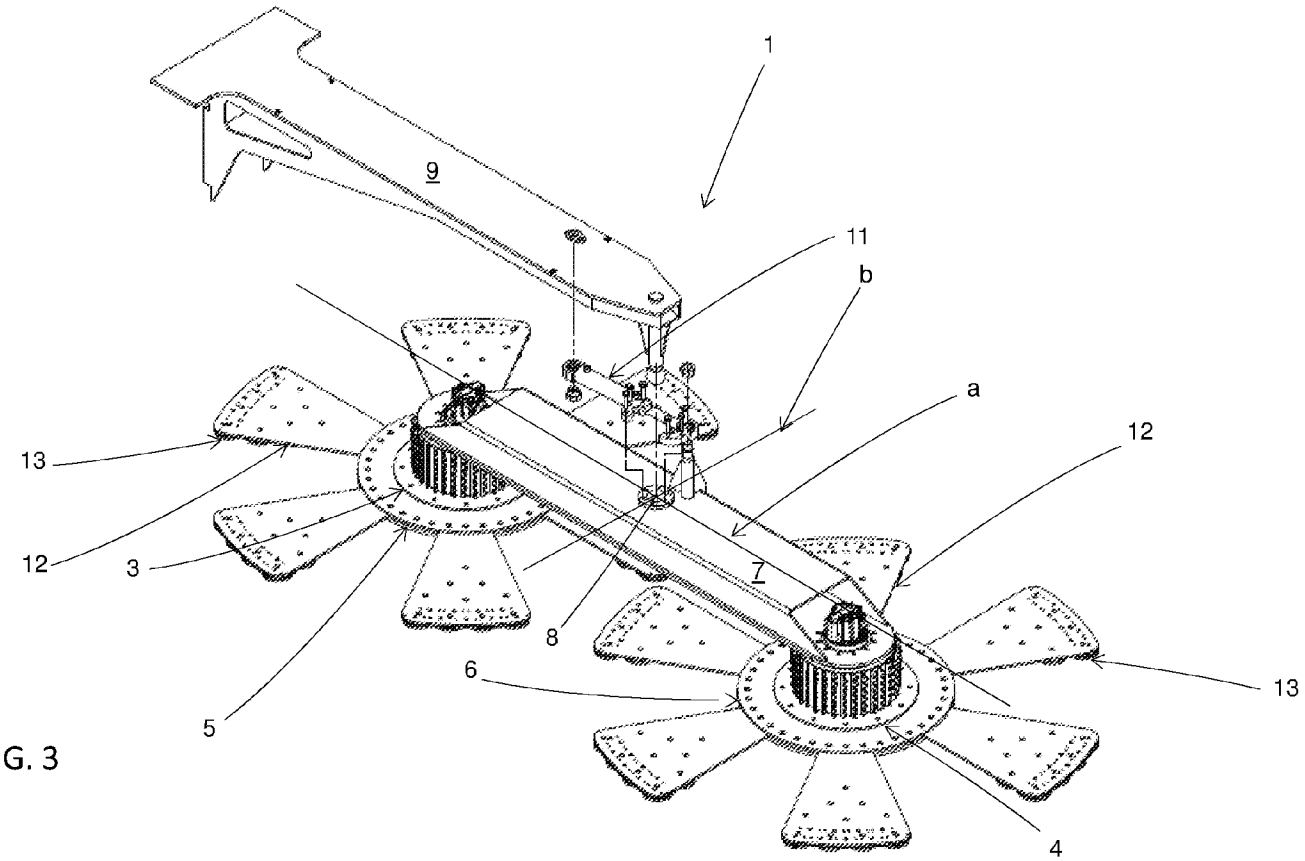
FIG. 3 is an enlarged exploded view of the rigid girder, millingheads and circular discs.

As is evident from the view in FIG. 2, where the unit is seen from underneath, the width of the working surface can be reduced substantially by tilting the rigid girder with the machining and milling tools, respectively, mounted thereon. By arranging the rigid girder in parallel with the boom the working width is minimized, which is especially advantageous, when obstacles exist on the surface to be machined and milled, respectively, and/or when said surface is uneven.

The invention claimed is:

1. A grinding/milling machine for levelling of horizontal surfaces comprising:

a mobile drive unit, including a vertically pivotable boom, suspended on the mobile unit;

a rigid girder having two opposed ends and a central region there between which is arranged in a joint at one end of the boom; and two grinding and/or millingheads operated by motors, each being arranged at one of the opposite ends of the rigid girder;

whereby the rigid girder is fastened to said joint so that the rigid girder is turnable about a vertical axis in a horizontal plane at the same time as it is turnable around a longitudinal axis (a) for the girder, which longitudinal axis (a) traversing said joint, the rigid girder is also turnable around a transversal axis (b) which transversal axis (b) also traverses said joint, wherein a hydraulic cylinder is provided having one end attached to the boom at a location spaced from the vertical axis and a second end connected to the rigid girder at a location spaced from the longitudinal axis (a) and arranged in connection with the joint for controlled tilting of the rigid girder in relation to the boom about the longitudinal axis (a).

2. The grinding/milling machine according to claim 1, wherein said motors are hydraulic motors.

3. The grinding/milling machine according to claim 1, wherein in connection with the suspension of the boom at the mobile drive unit a second hydraulic cylinder is arranged for lifting up of the boom and for adapting the bearing pressure of the grinding and/or milling heads against the ground.

4. The grinding/milling machine according to claim 1, wherein the grinding and/or milling heads are comprised of circular discs with fasteners for tool carriers in the form of disc segments having a narrower radially inward fastening end and a wider radially outward working end, whereby the fasteners are arranged on at least one side the disc segments.

5. The grinding/milling machine according to claim 4, wherein the tool carriers are reversible and both sides of the disc segments have fasteners in order to carry similar or different tools on their respective sides.

* * * * *